US009597764B2

(12) United States Patent
Barsotti Giovanni

(10) Patent No.: US 9,597,764 B2
(45) Date of Patent: Mar. 21, 2017

(54) CUTTING MACHINE WITH GRINDING UNIT

(71) Applicant: UNIVERSAL TISSUE TECHNOLOGY SRL, Lucca (IT)

(72) Inventor: Bertoli Barsotti Giovanni, Lucca (IT)

(73) Assignee: Universal Tissue Technology, Lucca (IT)

( * ) Notice: Subject to any disclaimer, the term of this patent is extended or adjusted under 35 U.S.C. 154(b) by 322 days.

(21) Appl. No.: 14/151,127

(22) Filed: Jan. 9, 2014

(65) Prior Publication Data

US 2015/0068378 A1 Mar. 12, 2015

(30) Foreign Application Priority Data

Sep. 9, 2013 (CN) ..... 2013 1 0405489

(51) Int. Cl.

| | |
|---|---|
| ***B24B 27/00*** | (2006.01) |
| ***B24B 3/46*** | (2006.01) |
| ***B26D 7/12*** | (2006.01) |
| ***B26D 1/14*** | (2006.01) |

(52) U.S. Cl.

CPC ..... *B24B 3/463* (2013.01); *B26D 1/14* (2013.01); *B26D 7/12* (2013.01); *Y10T 83/303* (2015.04)

(58) Field of Classification Search

CPC .. B24D 15/00; B24B 1/00; B24B 3/46; B24B 3/463; B24B 27/0076; B24B 27/00; B26D 7/12

USPC ..... 451/45, 268, 269, 420, 65; 76/81.7

See application file for complete search history.

(56) References Cited

U.S. PATENT DOCUMENTS

| | | | | |
|---|---|---|---|---|
| 4,173,846 | A | 11/1979 | Steiner et al. | |
| 5,038,647 | A | 8/1991 | Biagiotti | |
| 5,641,321 | A * | 6/1997 | Suzuki | B24B 3/368 451/1 |
| 6,224,468 | B1 * | 5/2001 | Blume | B24B 3/463 451/293 |
| 6,644,154 | B2 | 11/2003 | Wierschke et al. | |
| 6,786,808 | B1 | 9/2004 | Biagiotti | |
| 8,037,794 | B2 | 10/2011 | Ridolfi et al. | |
| 8,910,553 | B2 | 12/2014 | Catelli | |
| 2001/0009122 | A1 | 7/2001 | Ciani et al. | |
| 2006/0000312 | A1 | 1/2006 | Chiocchetti et al. | |
| 2006/0011015 | A1 * | 1/2006 | Chiocchetti | B26D 7/12 76/81.7 |
| 2012/0184186 | A1 * | 7/2012 | Graham, Jr. | B23D 63/123 451/45 |
| 2014/0331838 | A1 * | 11/2014 | Baker | B26D 7/12 83/174 |

FOREIGN PATENT DOCUMENTS

| | | | |
|---|---|---|---|
| CN | 1708380 | A | 12/2005 |
| CN | 101808785 | A | 8/2010 |
| CN | 102524947 | A | 7/2012 |
| CN | 102783709 | A | 11/2012 |
| EP | 0391865 | A2 | 10/1990 |
| EP | 0677360 | A1 | 10/1995 |
| EP | 2196294 | A1 | 6/2010 |

(Continued)

*Primary Examiner* — Robert Rose

(74) *Attorney, Agent, or Firm* — Jeffrey Dean Lindsay

(57) ABSTRACT

A cutting machine includes a circular knife and a grinding unit for grinding the circular knife, wherein the grinding unit can be adjusted to grind the circular knife at different angles.

21 Claims, 7 Drawing Sheets

(56) References Cited

FOREIGN PATENT DOCUMENTS

| | | | |
|---|---|---|---|
| EP | 2471391 | A2 | 7/2012 |
| EP | 2524608 | A2 | 11/2012 |
| GB | 1091583 | | 11/1967 |
| GB | 1163932 | | 9/1969 |
| WO | 2004/039544 | A1 | 5/2004 |

* cited by examiner

CUTTING MACHINE WITH GRINDING UNIT

BACKGROUND

1. Technical Field

The present disclosure generally relates to a grinding unit for sharpening or grinding a rotating knife such as a rotating circular knife. The present disclosure also relates to a cutting machine having such a grinding unit for grinding a circular knife of the cutting machine. The cutting machine is used to cut web material such as tissue wound on tubular winding cores (which is called a "log") or other "logs" of material such as coreless rolls of tissue. The grinding unit of the cutting machine is capable of grinding the circular knife during the cutting process.

2. Description of the Related Art

In typical applications, a log such as a wound tissue log is cut into rolls of smaller size by a rotating circular knife of a cutting machine. The knife rotates around a shaft, and moves toward the log normal to the axis of the log to cut the log. Usually, the knife is substantially biconical in shape and has an axis and a cutting edge formed at an intersection of two bevel surfaces located at two opposite sides of the knife. The knife has a thickness greater in proximity to the axis thereof and gradually decreasing from the axis toward the cutting edge. Typically, for the purpose of increasing the rigidity and stability of the knife, each side of the knife forms two bevels with different angles. The knife must be ground frequently to restore the cutting edge. Conventionally, two grinding units are provided with different angles corresponding to the two bevels with different angles. Each grinding unit is to grind a corresponding bevel of each side of the knife. Though the cutting edge of the knife is capable of being restored in such a manner, there is a need for a more effective system for grinding the knife.

DETAILED DESCRIPTION OF EMBODIMENTS

Figure 1:
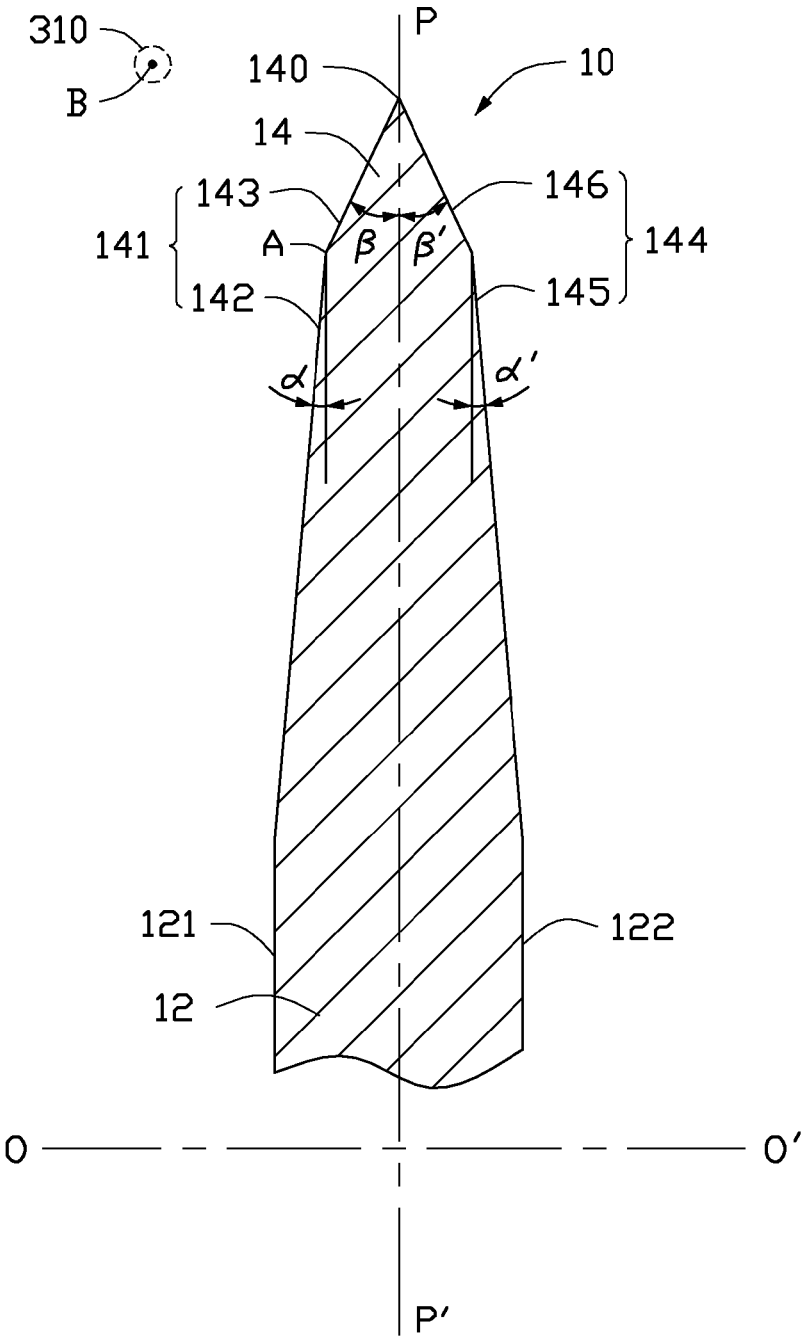
FIG. 1 partially shows a structure of a circular knife used in a cutting machine of an exemplary embodiment of the present disclosure.

Referring to FIG. 1, a circular knife 10 accommodated in a cutting machine in accordance with an exemplary embodiment of the present disclosure is partially shown. A grinding unit provided by the present disclosure is applied to grind such a circular knife 10.

The circular knife 10 comprises a main body 12 and a blade portion 14 extending from a periphery of the main body 12. The main body 12 has a disk shape. The main body

12 has two end surfaces 121, 122 opposite to each other. The end surfaces 121, 122 may generally be parallel to each other and orthogonal to a rotating axis OO' of the circular knife 10. The rotating axis OO' extends through a geometric center of the main body 12.

The blade portion 14 has two side surfaces 141, 144 opposite to each other. The side surface 141 extends away from a periphery of the end surface 121, and the side surface 144 extends away from a periphery of the end surface 122 and intersects with the side surface 141 to form a continuous cutting edge 140. The cutting edge 140 defines a plane PP' perpendicular to the rotating axis OO' of the circular knife 10 and each side of the cutting edge 140 has two bevels. That is, each side surface 141,144 has two bevels. Specifically, the side surface 141 comprises a first bevel 142 and a second bevel 143. The first bevel 142 interconnects the end surface 121 and the second bevel 143. The second bevel 143 is positioned between the first bevel 142 and the cutting edge 140. The first bevel 142 and the second bevel 143 are generally conical, and both have an axis coincident with the rotating axis OO'. The first bevel 142 and the second bevel 143 have different angles relative to the rotating axis OO'. In other words, as depicted, the first bevel 142 and the second bevel 143 are of different angles, which means that the angle between the first bevel 142 and the plane PP' of the cutting edge 140 is different from that between the second bevel 143 and the plane PP' of the cutting edge 140. In FIG. 1, the angle between the first bevel 142 and the plane PP' of the cutting edge 140 is designated as $\alpha$, and the angle between the second bevel 143 and the plane PP' of the cutting edge 140 is designated as $\beta$. In the present embodiment, $\alpha$ is about 5 degrees, and $\beta$ is about 15 degrees. It is noted that $\alpha$ and $\beta$ are not limited to that numeric value. Generally, $\alpha$ is smaller than $\beta$. By way of example, $\alpha$ may range from 1 to 40 degrees, from 5 to 40 degrees, from 10 to 40 degrees, from 10 to 25 degrees, and so forth. Also by way of example, $\beta$ may range from 5 to 60 degrees, such as from 5 to 50 degrees, from 10 to 45 degrees, from 15 to 30 degrees, and so forth.

Similar to the side surface 141, the side surface 144 comprises a first bevel 145 and a second bevel 146. The first bevel 145 interconnects the end surface 122 and the second bevel 146. The second bevel 146 is positioned between the first bevel 145 and the cutting edge 140. As shown in FIG. 1, the circular knife 10 is symmetric relative to the plane PP'. The distance between the end surface 121 and the plane PP' is equal to that between the end surface 122 and the plane PP'. The angle between the first bevel 145 and the plane PP' is $\alpha'$, and equal to that between the first bevel 142 and the plane PP'. The angle between the second bevel 146 and the plane PP' is $\beta'$, and equal to that between the second bevel 143 and the plane PP'. It is noted that in alternative embodiments, the circular knife 10 needs not to be strictly symmetric relative to the plane PP'. That is to say, the angle $\alpha'$ and $\beta'$ can be designed not equal to the angel $\alpha$ and $\beta$ respectively. Both $\alpha'$ and $\beta'$ may have values similar to those ranges previously listed.

Figure 2:
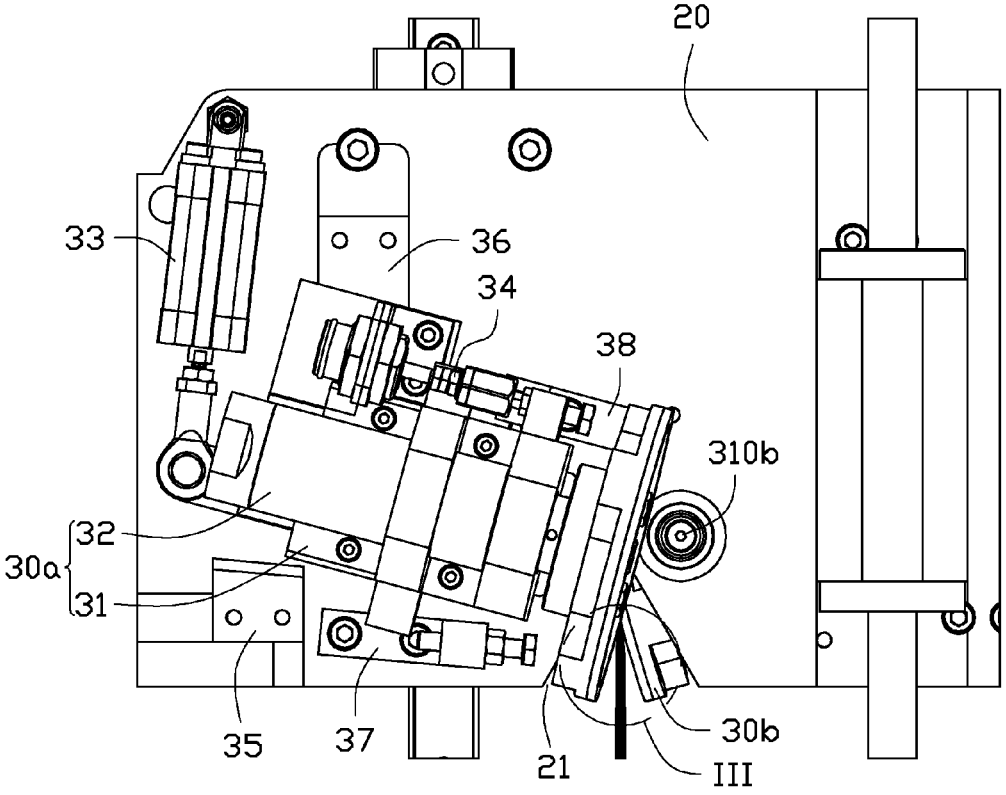
FIG. 2 is a side view of a grinding unit according to an exemplary embodiment of the present disclosure, in which a circular knife is also shown.
Figure 3:
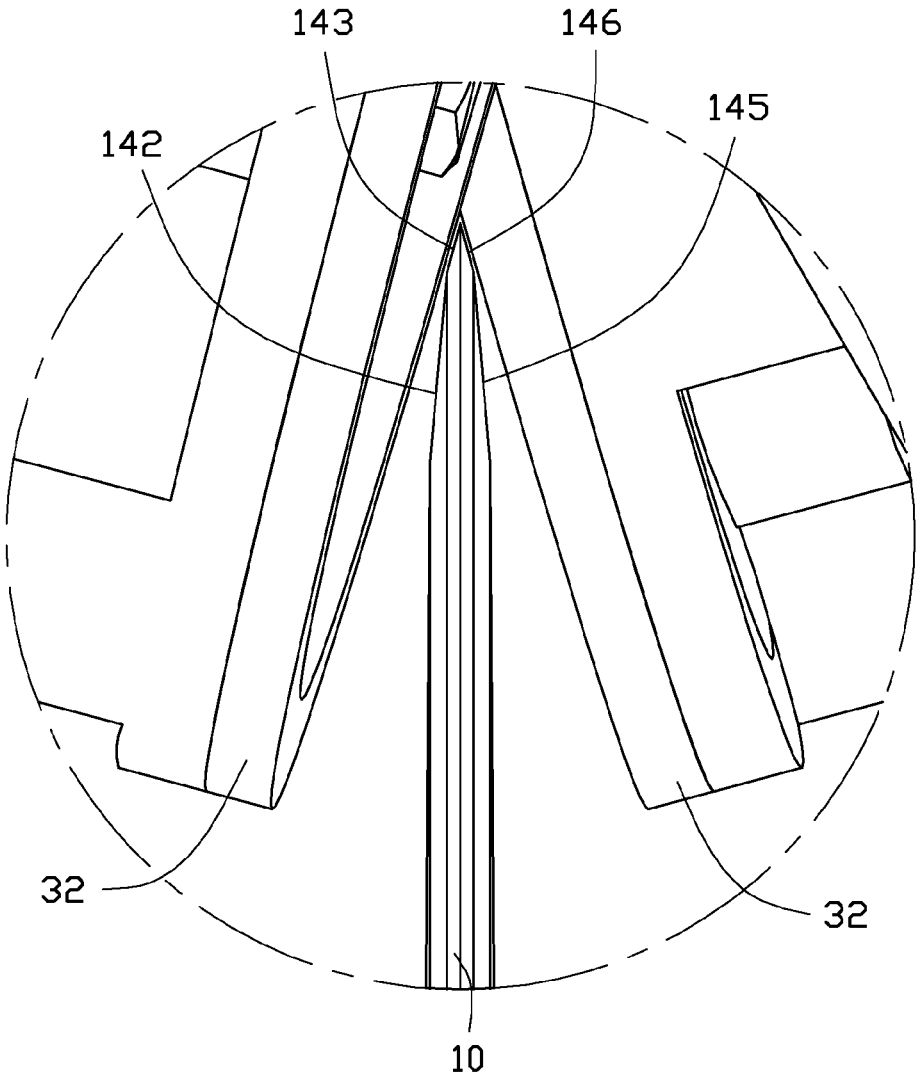
FIG. 3 is an enlarged view of a circled portion III of FIG. 2.
Figure 4:
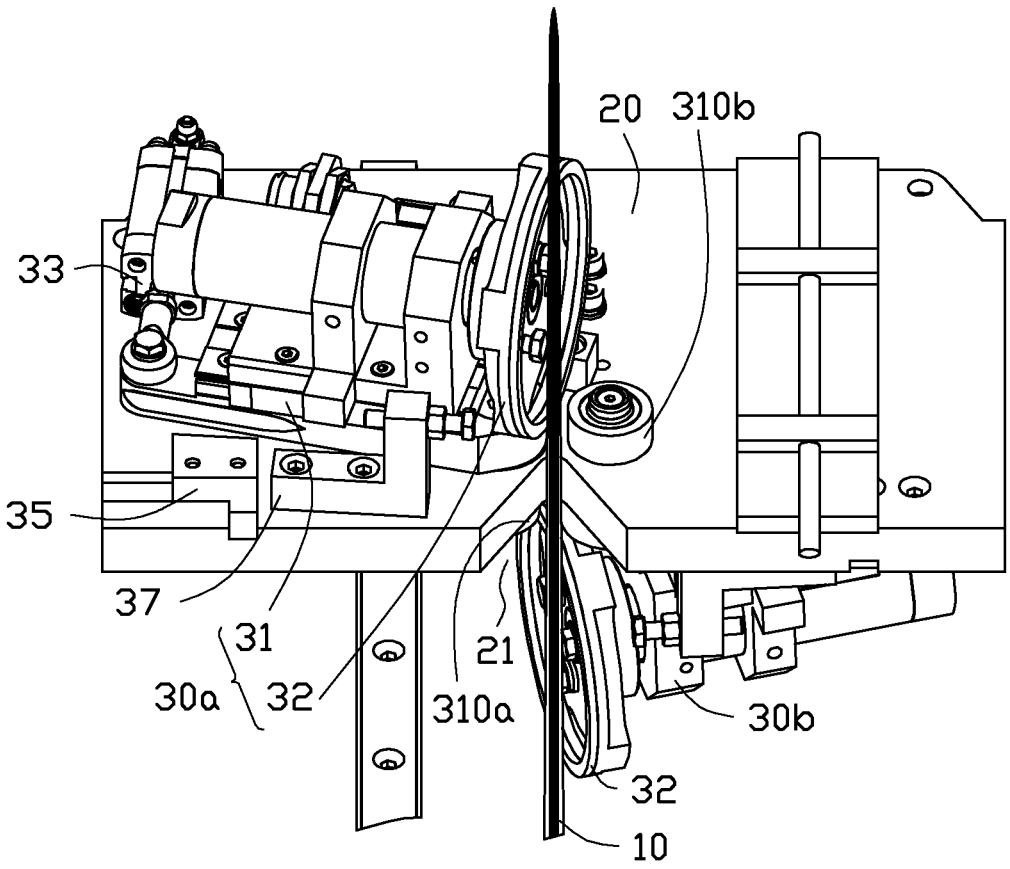
FIG. 4 is similar to FIG. 2, but showing the grinding unit and the circular knife in another aspect.

Also referring to FIG. 2, FIG. 3 and FIG. 4, the grinding unit comprises a frame 20 and two grinding heads 30*a*, 30*b* disposed on the frame 20. Each grinding head 30*a* or 30*b* is used to grind a corresponding side of the cutting edge 140. The grinding unit is capable of grinding the circular knife 10 after being removed from the cutting machine. The grinding unit also can be a part of the cutting machine, and accommodated with the circular knife 10 for grinding the circular knife 10 of the cutting machine when the circular knife 10 is in and/or out of a cutting process. The cutting machine is applied to cut a log such as a tissue log orthogonal to the axis of the log into rolls of smaller sizes. A typical cutting machine and grinding unit is disclosed in WO2004/039544, and also disclosed in WO2004/035273, both hereby incorporated by reference in their entireties to the degree they are not contradictory herewith, and reference may be had thereto for details of common construction and known operation not set forth herein.

The frame 20 can be an extension of a frame (not shown) for holding the rotating axis OO' of the circular knife 10. The frame 20 is configured as a rigid member such as a board, and the plane of the frame 20 is perpendicular to the plane PP' of the cutting edge 140. Each of the grinding heads 30*a* and 30*b* is positioned at a corresponding lateral side of the frame 20. The grinding head 30*a* is completely visible in FIG. 2, and only a part of the grinding head 30*b* is shown from a notch 21 defined in the frame 20. More details of the grinding head 30*b* can be seen in FIG. 4. The notch 21 is provided for an extension of the cutting edge 140 to be positioned between the two grinding heads 30*a*, 30*b* and facilitating the grinding of the side surfaces 141, 144 at two sides of the cutting edge 140.

The two grinding heads 30*a*, 30*b* have an identical structure and are of the same operation principles in the present embodiment, though differences between the two grinding heads 30*a*, 30*b* are possible within the scope of the present disclosure. The grinding head 30*a* is set forth as an example for a detailed description as follows.

The grinding head 30*a* comprises a support 31 and a grinding wheel 32 disposed on the support 31. The grinding wheel 32 is applied to contact and grind the side surface 141 or 144 of the circular knife 10.

The support 31 is pivotally connected to the frame 20, and is capable of rotating on the frame 20, which makes the grinding wheel 32 capable of rotating and changing an angle relative to the side surface 141 or 144.

Figure 5:
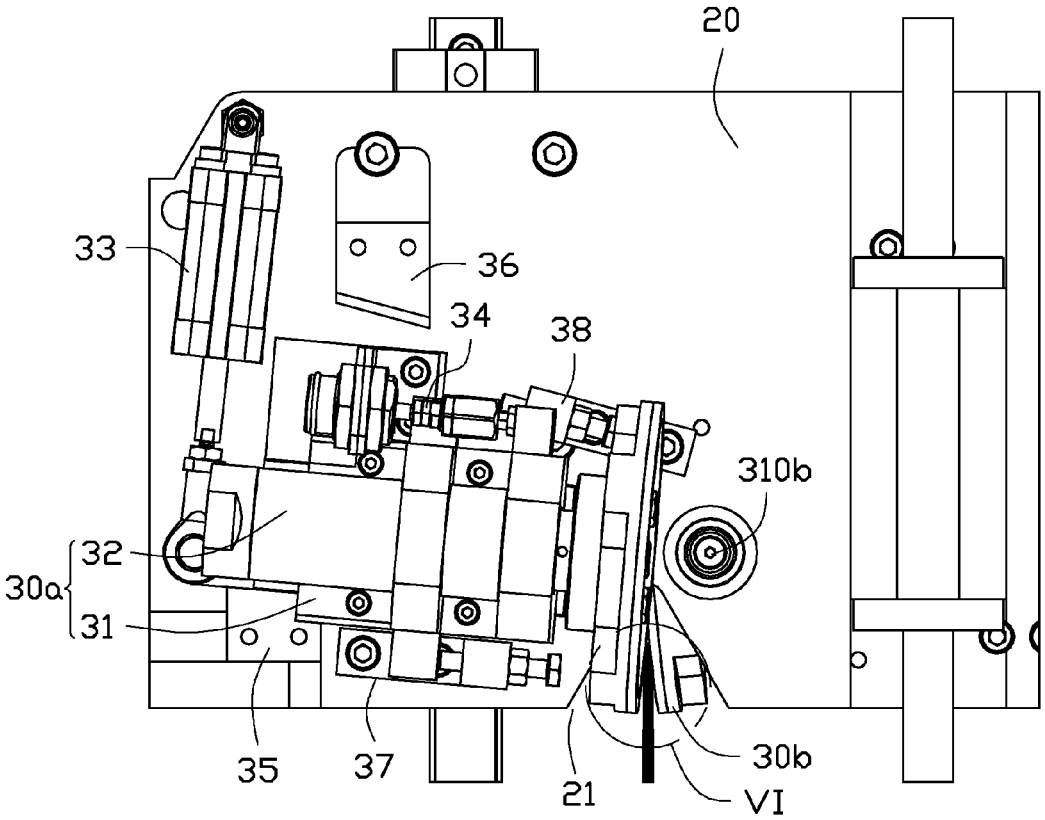
FIG. 5 is similar to FIG. 2, but with a different grinding angle of the grinding unit relative to the circular knife.
Figure 6:
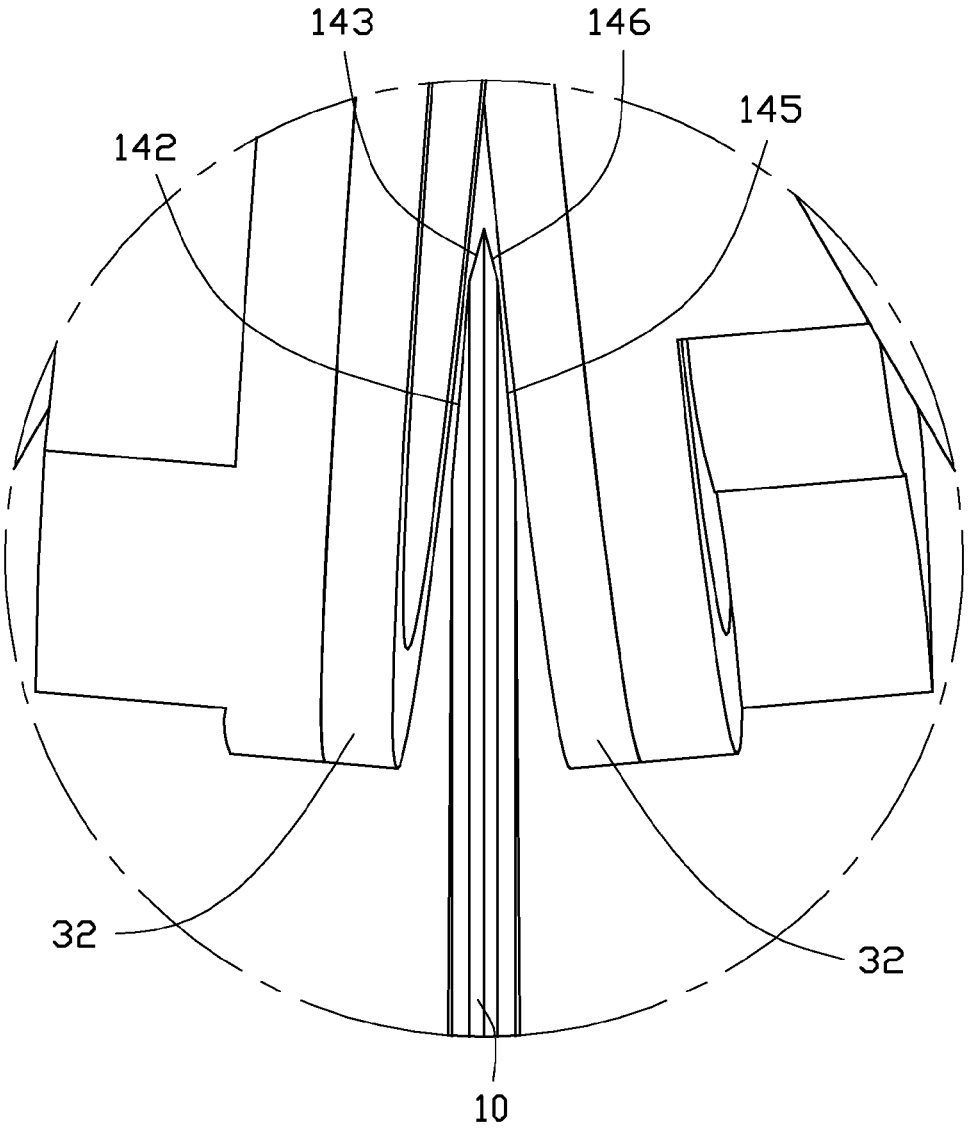
FIG. 6 is an enlarged view of a circled portion VI of FIG. 5.

With the rotation of the grinding head 30*a* or 30*b*, the angle between the grinding head 30*a* or 30*b* and the plane PP' of the cutting edge 140 of the circular knife 10 can be adjusted. That is, the angle between the grinding wheel 32 of the grinding head 30*a* or 30*b* and the side surfaces 141, 144 of the circular knife 10 can be adjusted. Through the adjustment of the angle between the grinding wheel 32 and the side surface 141 or 144, the first bevel 142 and the second bevel 143 of the side surface 141 with different angles can be ground by a single grinding head 30*a* or 30*b*, and there is no need for providing two grinding heads with different angles to grind the first and second bevels 142, 143 respectively. FIG. 2 and FIG. 3 show that the grinding wheels 32 are in a position of grinding the second bevels 143 and 146. Referring to FIG. 5 and FIG. 6, the position of the grinding wheels 32 are changed for grinding the first bevel 142 and 145. It is understood that, the grinding wheels 32 of the grinding heads 30*a*, 30*b* could be both motorized to grind or idle.

In the present embodiment, a first executive mechanism 33 is provided to connect the support 31 of the grinding head 30*a* and drive the grinding head 30*a* to rotate relative to the frame 20 around a pivot 310*a*. The pivot 310*a* is shielded by the grinding head 30*a* in FIG. 2, and at least part of the pivot 310*a* is shown in FIG. 4. The pivot 310*a* extends to perpendicular to the plane of the frame 20. A pivot 310*b* associated with the grinding head 30*b* is visible in FIG. 2, FIG. 4 and FIG. 5. The first executive mechanism 33 can be a pneumatic cylinder, a hydraulic cylinder and other types of actuating mechanisms. The first executive mechanism 33 has two ends. One end of the first executive mechanism 33 is pivoted on the frame 20, and the opposite other end of the first executive mechanism 33 is pivoted to the support 31 of the grinding head 30*a*. With the backward or forward movement of the first executive mechanism 33, the grinding head 30*a* rotates around the pivot 310*a* and is shifted between two positions for grinding the first and second bevels 142, 143. Specifically, as shown in FIG. 2, the executive mechanism 33 moves backward, and the grinding wheel 32 of the grinding head 30*a* is in the position of grinding the second bevel 143 of the circular knife 10. As shown in FIG. 5, the executive mechanism 33 moves forward, and the grinding wheel 32 of the grinding head 30*a* is in the position of grinding the first bevel 142.

FIG. 3 and FIG. 6 exemplarily show that the grinding wheels 32 coincide with the first bevels 142, 145 and second bevels 143, 146. It is noted that in actual grinding process, the grinding wheels 32 may be not coincident with the first bevels 142, 145 and second bevels 143, 146. With the capability of rotation of the grinding wheel 32 and changing the angles between the grinding wheel 32 and the plane PP' of the cutting edge 140, grinding bevels of different angles at each side of the circular knife 10 with a single grinding unit is achieved. The angles that the grinding wheel 32 rotates relative to the plane PP' of the cutting edge 140 can be managed at a desired number of degrees by controlling the movement of the first executive mechanism 33. Or in an alternative embodiment (not shown), the circular knife 10 to be ground has a single bevel at each side thereof. After grinding by the grinding unit provided by the present disclosure, a circular knife 10 as shown in FIG. 1, which has two bevels of different angles at each side thereof, can be obtained.

Further, in some embodiments, the first executive mechanism 33 can be controlled to shift the grinding head 30*a* between two fixed positions, such as the two positions as shown in FIG. 2 and FIG. 5. Moreover, a stopper can be disposed on the frame 20 for stopping the rotation of the support 31. A bottom stopper 35 and a top stopper 36 are shown in FIG. 2 and FIG. 5. In FIG. 2, the first executive mechanism 33 moves backward to drive the support 31 to rotate around the pivot 310*a* in clockwise, until the support 31 abuts against the top stopper 36 on the frame 20. With the top stopper 36, the rotation of the support 31 can be precisely controlled and the angle between the grinding wheel 32 and the plane PP' of the cutting edge 140 can be also precisely controlled to improve the grinding of the circular knife 10. Similarly, as shown in FIG. 5, the first executive mechanism 33 moves forward to drive the support 31 to rotate around the pivot 310*a* in anticlockwise, until the support 31 abuts against the bottom stopper 35 of the frame 20. With the bottom stopper 35, the rotation of the support 31, and the angle between the grinding wheel 32 and the plane PP' of the cutting edge 140 can be precisely controlled to improve the grinding of the circular knife 10.

Referring to FIG. 1 again, if the grinding wheel 32 rotates around the intersection A of the first and second bevels 142, 143, the grinding wheel 32 would match the first and second bevels 142, 143 perfectly (if is needed) during the rotation of the grinding wheel 32. However actually the grinding wheel 32 rotates around point B where the pivot 310*a* locates, instead of the intersection A. Thus, during the rotation of the grinding wheel 32, one of the bevels 142 and 143 would contact the grinding wheel 32 more than expected and the other would be apart from the grinding wheel 32, leading to imperfect contact and other problems such as excessive grinding or inadequate grinding on different portions of the circular knife 10. Therefore, there is a need to adjust the distance between the grinding wheel 32 and the bevel 142 or 143 after/before the rotation of the grinding wheel 32.

In one embodiment of the present disclosure, a second executive mechanism 34 is disposed on the grinding head 30*a* to meet such a requirement. The second executive mechanism 34 drives the grinding head 30*a* to adjust the distance between the grinding head 30*a* and the bevel 142 or 143 of the circular knife 10. Specifically, the second executive mechanism 34 is disposed on the support 31, and connects the grinding wheel 32. The second executive mechanism 34 drives the grinding wheel 32 to move relative to the support 31.

Similar to the first executive mechanism 33, the second executive mechanism 34 can be a pneumatic cylinder, a hydraulic cylinder, a solenoid, a belt or cable driven device, an air bag, or other types of actuating mechanisms. As shown in FIG. 2 and FIG. 3, the second executive mechanism 34 drives the grinding wheel 32 forward to the second bevel 143 of the circular knife 10. As shown in FIG. 5 and FIG. 6, the second executive mechanism 34 drives the grinding wheel 32 forward to the first bevel 142 of the circular knife 10. The extent of the movement of the grinding wheel 32 driven by the second executive mechanism 34 can be controlled according to actual requirements such as whether need to grind the bevel 142 or 143 or the grinding extent of the bevel 142 or 143. In the present embodiment, the forward movement of the second executive mechanism 34 is controlled by mechanical stops. As shown in FIG. 2, the forward movement of the second executive mechanism 34 is stopped by a mechanical stop 38 formed on the frame 20 to control the grinding extent of the second bevel 143. As shown in FIG. 5, the forward movement of the second executive mechanism 34 is stopped by a mechanical stop 37 formed on the frame 20 to control the grinding extent of the first bevel 142.

In the grinding process, the grinding wheel 32 moves backward from the bevel 142 or 143 before changing the angle between the grinding wheel 32 and the plane PP' of the cutting edge 140. After the grinding wheel 32 is shifted between different angles, the grinding wheel 32 is controlled to move forward to adjust the distance between the grinding wheel 32 and the bevel 142 or 143, and the extent of the forward movement of the grinding wheel 32 is controlled by the mechanism stop 37 or 38. Therefore, the second executive mechanism 34 functions as a clutch for making the grinding head 30*a* meet a suitable portion of the circular knife 10 or move apart therefrom.

In other embodiments, the frame 20 can be designed as capable of moving along a direction parallel to the plane of the frame 20 and forward/backward the rotating axis OO' of the circular knife 10. For example, a rail (not shown) may be disposed on the frame 20, and the frame 20 may move along the rail. In such a manner, the grinding heads 30*a*, 30*b* and the circular knife 10 can also be meet or be parted as desired.

With the rotation of the grinding head 30*a*, a circular knife of which each side having double bevels of different angles can be ground by a single grinding unit provided by the present disclosure. Compared with conventional systems, related costs and maintenance are reduced by the solution provided in the present disclosure. Especially in the cutting machine equipped with the grinding unit provided by the present disclosure, the circular knife having two bevels of different angles at each side thereof can be ground as desired, and the need for providing two or more grinding units for such a circular knife is eliminated, which simplifying the structure of the cutting machine and reducing the maintenance cost of the cutting machine.

Figure 7:
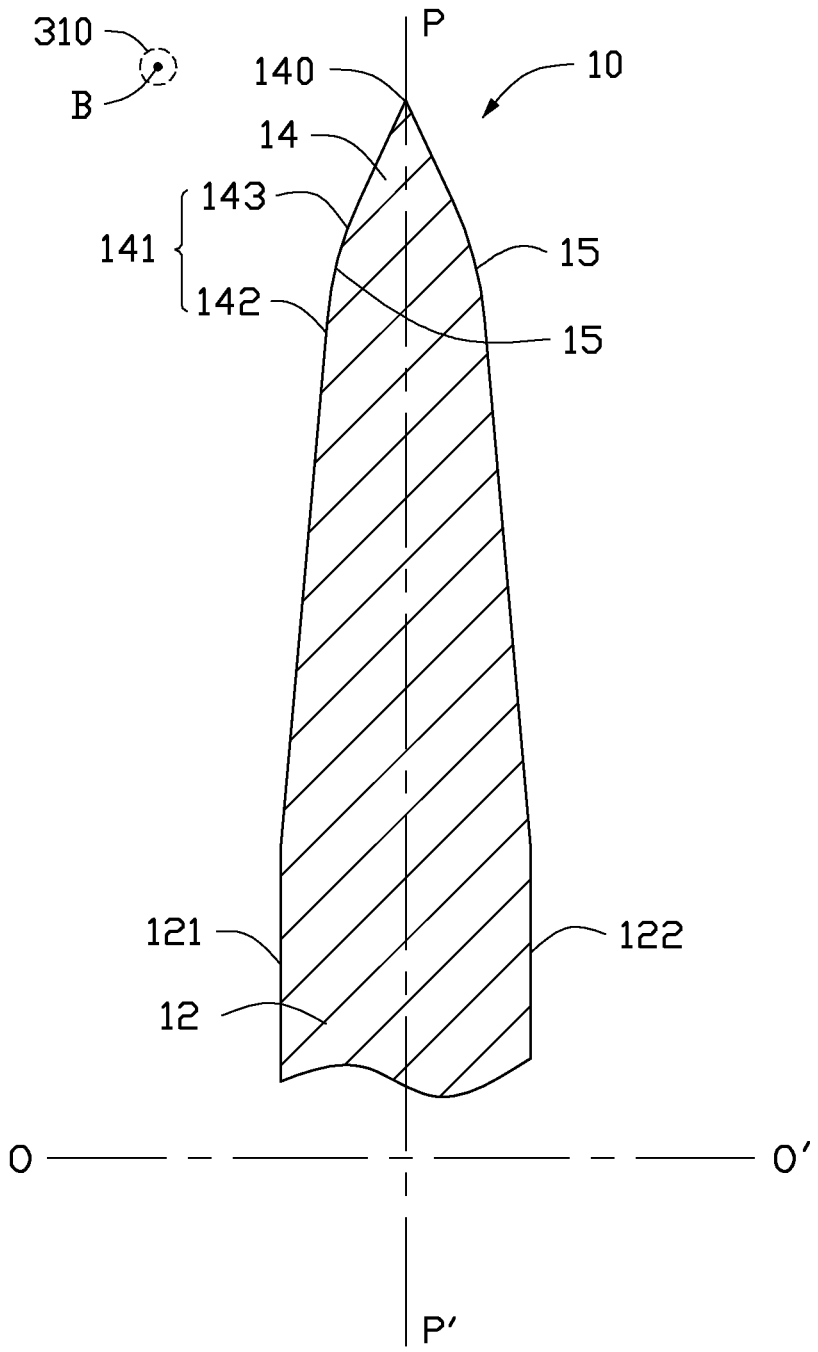
FIG. 7 partially shows a structure of a circular knife used in a cutting machine of another exemplary embodiment of the present disclosure.

In an additional embodiment, as shown in FIG. 7, the circular knife 10 to be ground can have two bevels on each side thereof and a chamfer 15 formed between the two bevels. The circular knife 10 having such "rounded" bevels has a better robustness and capacity of penetration. The chamfer 15 can be obtained by combining the separate movement of the first executive mechanism 33 and second executive mechanism 34 simultaneously during the grinding process.

It is to be further understood that even though numerous characteristics and advantages have been set forth in the foregoing description of embodiments, together with details of the structures and functions of the embodiments, the disclosure is illustrative only; and that changes may be made in detail, especially in matters of shape, size, and arrangement of parts within the principles of the disclosure to the full extent indicated by the broad general meaning of the terms in which the appended claims are expressed.

What is claimed is:

1. A grinding unit for grinding a circular knife, the circular knife having a rotating axis, and a continuous cutting edge which defines a plane perpendicular to the rotating axis of the circular knife and has two sides, the grinding unit comprising:

a frame;

two grinding heads pivotally connected to the frame for respectively grinding the two sides of the cutting edge; and two first executive mechanisms operatively associated with the two grinding heads and respectively adapted to adjust the position of the grinding heads for changing the angles between the grinding heads and the plane of the cutting edge.

2. The grinding unit of claim 1, wherein each grinding head comprises a support and a grinding wheel disposed on the support, the support pivotally connecting the frame, and each first executive mechanism connecting the support to rotate the support and the grinding wheel for changing the angle between the grinding wheel and the plane of the cutting edge.

3. The grinding unit of claim 2 further comprising two second executive mechanisms, each second executive mechanism connecting a corresponding grinding head to drive the corresponding grinding head for adjusting the distance between the corresponding grinding head and the cutting edge.

4. The grinding unit of claim 3, wherein each second executive mechanism connects the grinding wheel of the corresponding grinding head for moving the grinding wheel relative to the support to change the distance between the grinding wheel and the cutting edge.

5. The grinding unit of claim 2, wherein each side of the cutting edge has two bevels, the angles between the bevels and the plane of the cutting edge are different from each other, and each first executive mechanism is applied to rotate the grinding wheel to an angle suitable for grinding either of the two bevels.

6. The grinding unit of claim 2, wherein two stoppers are formed on the frame associated respectively with each grinding head for controlling the rotation of the each grinding head.

7. The grinding unit of claim 1, wherein the frame is a rigid member and defines a plane which is perpendicular to the plane of the cutting edge, each grinding head is pivotally connected to the frame via a pivot, and the pivot extends perpendicularly to the plane of the frame.

8. The grinding unit of claim 7, wherein the frame is capable of moving along a direction parallel to the plane of the frame and forward or backward with respect to the rotating axis of the circular knife.

9. A cutting machine for cutting a log, the cutting machine comprising:

a circular knife having a rotating axis and a continuous cutting edge which defines a plane perpendicular to the rotating axis and has two sides; and a grinding unit for grinding the circular knife, the grinding unit comprising a frame;

two grinding heads pivotally disposed on the frame for respectively grinding the two sides of the cutting edge; and two first executive mechanisms respectively connecting the grinding heads to rotate the grinding heads for changing the angles between the grinding heads and the plane of the cutting edge.

10. The cutting machine of claim 9, wherein each side of the cutting edge forms two bevels, and the angles between the bevels and the plane of the cutting edge are different from each other.

11. The cutting machine of claim 10, wherein each grinding head comprises a support and a grinding wheel disposed on the support, the support pivotally connecting the frame, and each first executive mechanism connecting the support to rotate the support and the grinding wheel for changing the angle between the grinding wheel and the plane of the cutting edge.

12. The cutting machine of claim 11 further comprising two second executive mechanisms respectively connecting the grinding heads to move the grinding heads to adjust the distance between the grinding heads and the cutting edge, wherein each second executive mechanism connects the grinding wheel of a corresponding grinding head to move the grinding wheel relative to the support for changing the distance between the grinding wheel and the cutting edge.

13. The cutting machine of claim 10, wherein each first executive mechanism is applied to rotate the grinding wheel to match any of the bevels of each side of the cutting edge.

14. The cutting machine of claim 10, wherein two stoppers are formed on the frame corresponding to each grinding head for controlling the degree of rotation of each grinding head.

15. The cutting machine of claim 9, wherein the frame is a rigid member that defines a plane which is substantially perpendicular to the plane of the cutting edge, the each grinding head is pivotally connected to the frame via a pivot, and the pivot extends perpendicularly to the plane of the frame.

16. The cutting machine of claim 15, wherein the frame is capable of moving along a direction parallel to the plane of the frame and forward or backward relative to the rotating axis of the circular knife.

17. A grinding unit for grinding a circular knife, the circular knife having a continuous cutting edge which defines a plane and has two sides, each side of the cutting edge forming two bevels, the angles between the bevels and the plane of the cutting edge being different from each other, the grinding unit comprising:

a frame;

two grinding heads pivotally connected to the frame, each grinding head for grinding a corresponding side of the cutting edge; and at least one executive mechanism connecting the grinding head, the at least one executive mechanism driving the grinding head to shift between a first position where the grinding head forming one of the two bevels of the corresponding side of the cutting edge, and a second position where the grinding head forming the other of the two bevels of the corresponding side of the cutting edge.

18. The grinding unit of claim 17, wherein the at least one executive mechanism comprises a first executive mechanism and a second executive mechanism, the first executive mechanism connecting the grinding head to rotate the grinding head for changing the angle between the grinding head and the plane of the cutting edge, and the second executive mechanism connecting the grinding head to move the grinding head to adjust the distance between the grinding head and the cutting edge.

19. A cutting machine for cutting a log, the cutting machine comprising:

a circular knife having a rotating axis and a continuous cutting edge which defines a plane and has two sides, each side of the cutting edge forming two bevels of different angles; and a grinding unit for grinding the circular knife, the grinding unit comprising a frame;

two grinding heads pivotally connected to the frame, each grinding head for grinding a corresponding side of the cutting edge; and at least one executive mechanism connecting the grinding head, the at least one executive mechanism driving the grinding head to shift between a first position where the grinding head forming one of the two bevels of the corresponding side of the cutting edge, and a second position where the each grinding head forming the other of the two bevels of the corresponding side of the cutting edge.

20. The cutting machine of claim 19, wherein the at least one executive mechanism comprises a first executive mechanism and a second executive mechanism, the first executive mechanism connecting the grinding head to rotate the grinding head for changing the angle between the grinding head and the plane of the cutting edge, and the second executive mechanism connecting the grinding head for moving the grinding head to adjust the distance between the grinding head and the cutting edge.

21. The cutting machine of claim 19, wherein a chamfer is formed between the bevels of each side of the cutting edge.

* * * * *